United States Patent [19]

Guerin et al.

[11] Patent Number: 4,958,364

[45] Date of Patent: Sep. 18, 1990

[54] ROTATING ANODE OF COMPOSITE MATERIAL FOR X-RAY TUBES

[75] Inventors: Christine Guerin, Paris; Jean-Marie Penato, Les Essarts le Roi; Yves Debrouwer, Charenton le Pont, all of France

[73] Assignee: General Electric CGR SA, Paris, France

[21] Appl. No.: 288,562

[22] Filed: Dec. 22, 1988

[30] Foreign Application Priority Data

Dec. 22, 1987 [FR] France ..... 87 17882

[51] Int. Cl.[5] ..... H01J 35/10

[52] U.S. Cl. ..... 378/144; 378/143

[58] Field of Search ..... 378/143, 144

[56] References Cited

U.S. PATENT DOCUMENTS

| | | | |
|---|---|---|---|
| 3,753,021 | 8/1973 | Braun | 378/144 |
| 3,795,832 | 3/1974 | Holland | 378/144 |
| 3,821,581 | 6/1974 | Holland et al. | 378/144 |
| 3,900,751 | 8/1975 | Holland et al. | 378/144 |
| 4,189,658 | 2/1980 | Schleinkofer | 378/144 |
| 4,344,012 | 8/1982 | Hubner et al. | 378/144 |
| 4,392,238 | 7/1983 | Lersmacher et al. | 378/144 |
| 4,461,019 | 7/1984 | Lersmacher | 378/144 |
| 4,799,250 | 1/1989 | Penato et al. | 378/144 |
| 4,847,883 | 7/1989 | Fourre | 378/143 |

FOREIGN PATENT DOCUMENTS

| | | |
|---|---|---|
| 0050893 | 5/1982 | European Pat. Off. . |
| 2593325 | 7/1987 | France . |
| 2593638 | 7/1987 | France . |
| 225343 | 11/1985 | Japan . |

OTHER PUBLICATIONS

Patent Abstracts of Japan, vol. 10, No. 79(E-391)[2136], Mar. 28, 1986.

*Primary Examiner*—Craig E. Church
*Assistant Examiner*—John C. Freeman
*Attorney, Agent, or Firm*—Oblon, Spivak, McClelland, Maier & Neustadt

[57] ABSTRACT

A rotating anode for X-ray tube including a base body on which target is formed by the deposit of at least one layer of target material wherein said base body includes a first central section comprising at least to some extent a carbon-carbon composite material and a second part of monolithic graphite supporting target arranged at least partly at the periphery of the former with the two parts bound mechanically to one another by a means of interconnection, such as brazing at the junction point of the two parts.

7 Claims, 2 Drawing Sheets

ROTATING ANODE OF COMPOSITE MATERIAL FOR X-RAY TUBES

FIELD OF THE INVENTION

The present invention relates to an X-ray tube rotating anode, particularly to an anode of the tupe including a base body of carbon-carbon composite material bearing a target by the deposit of at least one layer of X-ray emissive material.

DESCRIPTION OF THE PRIOR ART

With X-ray tubes, in particular those used for medical diagnosis, X-radiation is obtained by the electronic bombardment of a layer of target material, i.e. generally a high atomic rating refractory material which is a good conductor of heat: such target material generally being made up, for instance, of tungsten, molybdenum or alloys, thereof etc.

A small surface of the target is bombarded, referred to as the focal point, forming the source of X-radiation. The high levels of instantaneous power involved (in the range of 100 kW) combined with the small size of this focal point have for many years led manufacturers to make the anode rotate in order to distribute the thermal flux throughout a crown referred to as the focal crown, having a far larger area than the focal point.

From the thermal standpoint, the gain increases proportionally as the linear speed of movement of the focal crown beneath the focal point rises; the rising of this speed of movement is obtained by either elevating the speed of rotation of the rotating anode or by increasing the diameter of the anode.

However, one of the limits to raising the speed of rotation or to increasing the anode's diameter is the risk of the component materials of the anode shattering.

Indeed, it is current practice in the art to use rotating anodes of a type including a base body or substrate, generally in the form of a disc and on which one or several layers of X-ray emissive or target material is or are deposited. In general, the adhesion of the layer of target material on the base body is improved by the prior deposit of an intermediate attaching layer of rhenium for instance, while the target material layer is deposited on the intermediate attaching layer. The base body is currently made of so-called monolithic graphite which has excellent characteristics of thermal conductivity and emissivity. However, one of the drawbacks of graphite is that it is to some extent mechanically fragile, preventing the anode from being rotated at very high speeds.

But there is another material of the carbon-carbon composite type whose thermal properties and, above all, whose mechanical properties are favorable for its use within the scope of anodes rotating at high speed. The carbon-carbon composite material consists of a fibrous fabric formed by the two or three dimensional interlacing of carbon fibers the mesh of which is filled with a carbon matrix. One of the drawbacks that the carbon-carbon composite material involves is that there is a very low dilatation coefficient, around zero and that consequently, if differs greatly from the dilatation coefficient of most target materials, and notably pure or alloyed tungsten. This can cause, in particular, shearing effects at the interface between the outer layers of the carbon-carbon composite material and the material-target layer or even with the intermediate attaching layer, which generally has a dilatation coefficient similar to that of the target material.

This invention relates to an X-ray tube rotating anode which can be used at high speeds of rotation or with large diameters and which does not present any of the aforementioned drawbacks. This can be obtained by constructing a base body or mixed substrate, i.e., including a monolithic graphite for instance, as well as carbon-carbon composite, which two materials play a specific part.

In accordance with the invention, a rotating anode of an X-ray tube comprising a base body, which base body supports a target formed by the deposit of at least one layer of target material is characterized in that the base body includes a first section of composite carbon-carbon composite material and a second part of graphite of the monolithic type supporting the target. This arrangement means that the first part of the carbon-carbon composite material can more particularly serve to attach the anode so that the second part of (monolithic) graphite can provide particularly adhesion between the layer of target material while also providing for thermal conductivity. Better understanding of the invention will be gained from the description which follows, given as a non-limitative example, and the two attached figures among which:

DETAILED DESCRIPTION OF THE PREFERRED EMBODIMENT

Figure 1:
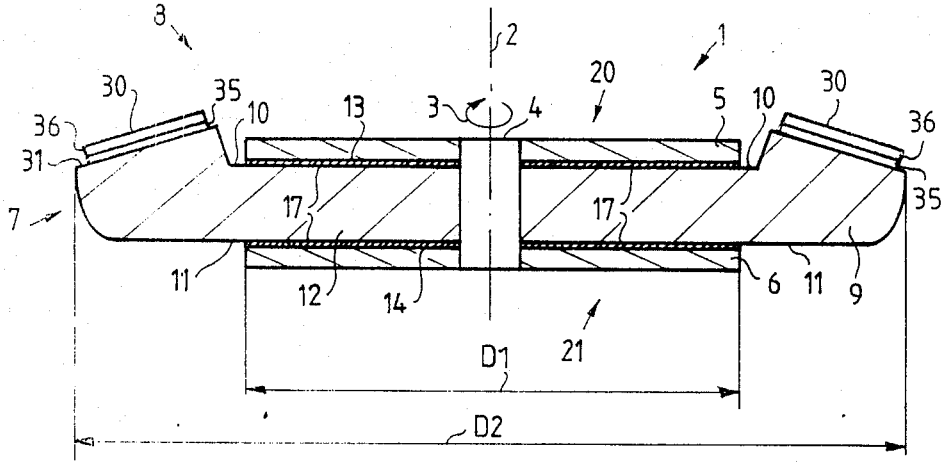
FIG. 1 is a schematic cross-sectional view showing a rotating anode according to in the invention.

FIG. 1 discloses, as a non-limitative example, a rotating anode 1 for an X-ray tube (not shown). Anode 1 consists of a base body 8 in the general form of a disc having its axis of symmetry 2 about which anode 1 is designed to rotate as symbolized by an arrow 3.

In the non-limitative example of the first embodiment of the example, shown in FIG. 1, rotating anode 1 consists on the one hand of two circular plates 5, 6 centered on the axis of symmetry 2 having approximately the same diameter D1; said two plates 5, 6 are of carbon-carbon composite material. Rotating anode 1 includes, on the other hand, a disc 7 of graphite of the type customarily used in anodes, for instance of monolithic graphite. Disc 7 is placed between the two plates 5, 6 and has an axis of symmetry which is one and the same as the axis of symmetry 2 of anode 1. In the non-limitative example described here, plates 5, 6 and disc 7 of the graphite are drilled in such a way as to form a hole 4 placed on axis of symmetry 2 and designed to attach rotating anode 1 to its support (not shown).

Both plates 5, 6 are strongly and rigidly linked with one another by graphite disc 7. For this purpose, a first and second inner face 10, 11 of graphite disc 7 are held integral and bound respectively to a first internal face 13 of first plate 5 and to a second internal face 14 of second plate 6. These connections between faces 10, 11 of graphite disc 7 and internal faces 13, 14 of plates 5, 6 are obtained, for instance, by bonding or brazing (or by any other measn) as symbolized in FIG. 1 by the brazing layers 17 formed between inner faces 10, 11 of graphite disc 7 and inner faces 13, 14 of plates 5, 6, i.e. at the junction of these parts.

Graphite disc 7 has a second diameter D2 greater than first diameter D1 of plates 5, 6 so that, with respect to the latter, graphite disc 7 includes body 12 sandwiched between plates 5, 6 and a protruding part 9 forming a peripheral ring of graphite. In this configuration, both main faces 20, 21 of rotating anode 1 appear with a central part formed by plates 5, 6 of carbon-carbon composite material and a peripheral part formed by graphite peripheral ring 9.

The carbon-carbon composite plates 5, 6 endow rotating anode 1 with the necessary mechanical rigidity; and the graphite peripheral ring 9 designed specifically to support a target 30 which undergoes electronic bombardment to produce in the manner conventional per se, X-radiation. Accordingly, in the non-limitative example described herein, an outer face 31 of the peripheral ring 9, located alongside of the first plate 5 is inclined with respect to the plane of plate 5 to form about the latter a sloping section 31 on which a target 30 is formed. According to a method, conventional per se, an intermediate attaching layer 35 of rhenium, for instance, is deposited on said sloping section 31 and at least one layer of target material 36 is deposited on intermediate attaching layer 35 forming target 30.

Figure 2:
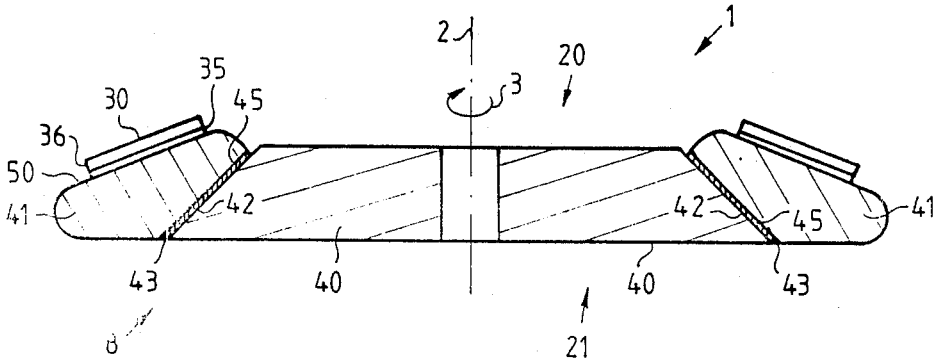
FIG. 2 is a schematic cross-sectional view showing a second embodiment of the anode according to the invention.

FIG. 2 schematically discloses a second embodiment of the rotating anode 1 in accordance with the invention.

In this embodiment of the invention, rotating anode 1 contains a main disc 40 of carbon-carbon composite material axis of symmetry 2 of which is designed to form the axis of rotation of rotating anode 1. The rotating anode also includes a second graphite ring 41 centered on the axis of symmetry 2 which is attached to the edge of main disc 40, on a section 42 of the latter. The second graphite ring 41 is made integral or attached strongly to main disc 40 by a connecting element, e.g. by brazing (or by any other means), symbolized in FIG. 2 by a brazing layer 43; said brazing layer 43 is formed between edge 42 of main disc 40 and an internal surface 45 by which the second graphite ring 41 is made integral with main disc 40.

Figure 3:
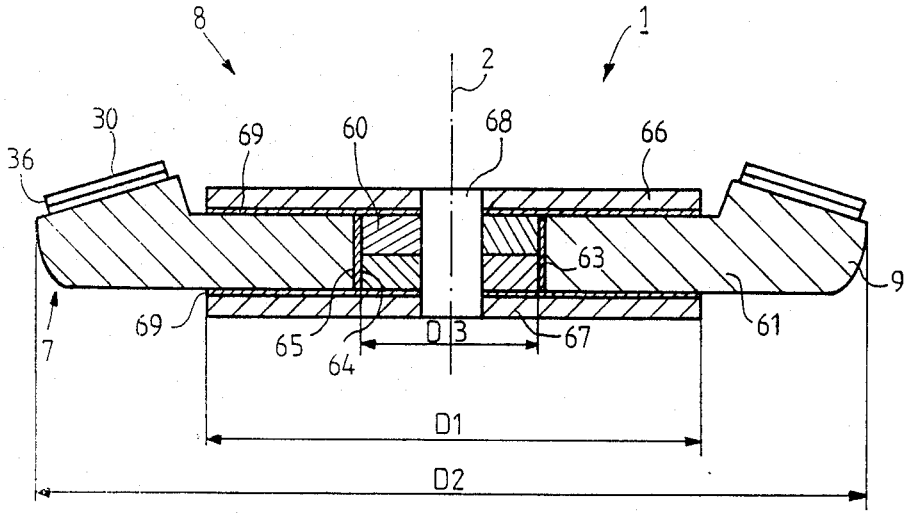
FIG. 3 is a schematic non-sectional view showing a third embodiment of the anode according to the invention.

As in the case of prior graphite ring 9 of the first embodiment, the second graphite ring 41 forms a support for a target 30 which is intended for electronic bombardment. As in the prior example, target 30 is borne on the sloping face 50 of second graphite ring 41; target 30 comprises a layer of target material 36 deposited on an intermediate attaching layer 35 which itself is deposited on sloping face 50 of the second target support of the second graphite ring 41. FIG. 3 shows a third embodiment of the rotating anode in accordance with the invention.

In this embodiment of the invention, the rotating anode 1 comprises a center hub 60 of carbon-carbon composite material the axis of symmetry of which is designed to form the axis of rotation of the rotating anode 1. The rotating anode 1 also includes a graphite ring 61, centered on the axis of symmetry 2 which is attached to the peripheral part 64 of the hub 60. The graphite ring 61 is made integral or attached strongly to the hub 65 by a connecting element e.g. by brazing (or by any other means), symbolized in FIG. 3 by a brazing layer 63. This brazing layer 63 is formed between the outer peripheral level surface 64 of the hub 60 and on the inner surface of the graphite ring 61.

The thicknesses of the hub 60 and of the ring 61 are equal and the relative positions of the two elements are such that their lateral faces are aligned with one another. In order to reinforce the mechanical properties of the assembly, the hub 60 and the ring 61 are maintained between two plates 66 and 67 of circular shape which are centered on the axis of symmetry 2 and have the same diameter D1. Both plates 66 and 67 consist of carbon-carbon composite material and are dulled in order to show the hole 68 which is placed around the axis of symmetry 2 and which is designed to allow the fixing of the rotating anode 1 on its support (not shown).

Both plates 66 and 67 are strongly and rigidly connected between one another via the hub 60 and ring 61, this connection being obtained by bonding or brazing (or by any other means), as symbolized in FIG. 3 by the brazing layers 69 formed between the plates 66, 67 on the one hand and the hub 61 on the other hand.

The manufacturing examples described hereabove are non-limitative examples; other configurations can be made without exceeding the scope of this invention, providing that to form a rotating anode, whereby a section of carbon-carbon composite material intended to ensure the mechanical fixing of the anode and a graphite section intended to bear the target and ensure its adhesion while also ensuring thermal conductivity are assembled with the two parts held mechanically integral or connected to one another by means of a connection, placed particularly at the junction point of this contact surface thereof, by brazing for instance.

We claim:

1. A rotating anode for X-ray tube having an axis of rotation including a base body on which a target is formed by the deposit of at least one layer of target material wherein said base body includes a first disc shaped central section portion having the same axis as said axis of rotation and comprising at least a carbon-carbon composite material and wherein said base body further includes a second portion of graphite supporting said target and arranged at least partly beyond the axial projection of said first central disc shaped portion with said first and second portions bound mechanically to one another by means of a brazing interconnection at the junction point of said first and second portions.

2. A rotating anode according to claim 1, wherein said first disc shaped central section portion has a first outside diameter with respect to said axis of rotation and that the second portion is concentric with said first disc shaped central section portion and has a second diameter with respect to said axis of rotation greater than said first diameter.

3. A rotating anode according to claim 1 or 2, wherein said second portion includes a graphite ring, said ring bearing the target.

4. A rotating anode according to claim 3 wherein said first disc shaped central section portion of carbon-carbon composite material includes a first and a second plate and said graphite ring is supported by a graphite body, while said graphite body is arranged between both plates.

5. A rotating anode according to claim 3 wherein first disc shaped central section portion of carbon-carbon composite material consists of a main disc supporting the graphite ring.

6. A rotating anode according to claim 5 wherein said first central section portion of carbon-carbon composite material comprises a main disc bearing the graphite ring.

7. A rotating anode according to claim 4 wherein said first disc shaped central section portion of carbon-carbon composite material additionally includes a disc shaped hub concentrically placed between said first and second plates and rigidly secured to said plates, the outer diameter D3 of said hub with respect to said axis of rotation being smaller than D1 the diameter of said first and second plates with respect to said axis of rotation.

* * * * *